US006293417B1

(12) United States Patent
Varfeldt

(10) Patent No.: US 6,293,417 B1
(45) Date of Patent: Sep. 25, 2001

(54) COLLAPSIBLE CONTAINER AND METHOD FOR THE ASSEMBLY OF SUCH A CONTAINER

(75) Inventor: Rasmus Varfeldt, Helsingborg (SE)

(73) Assignee: Perstorp Plastics Systems AB, Perstorp (SE)

( * ) Notice: Subject to any disclaimer, the term of this patent is extended or adjusted under 35 U.S.C. 154(b) by 0 days.

(21) Appl. No.: 09/623,993

(22) PCT Filed: Mar. 10, 1999

(86) PCT No.: PCT/SE99/00358

§ 371 Date: Dec. 6, 2000

§ 102(e) Date: Dec. 6, 2000

(87) PCT Pub. No.: WO99/46173

PCT Pub. Date: Sep. 16, 1999

(30) Foreign Application Priority Data

Mar. 13, 1998 (SE) ..... 9800816

(51) Int. Cl.[7] ..... B65D 6/18
(52) U.S. Cl. ..... 220/6
(58) Field of Search ..... 220/6, 7

(56) References Cited

U.S. PATENT DOCUMENTS 4,099,640 * 7/1978 Nessfield et al. ..... 220/6
4,735,330 * 4/1988 Hoss ..... 220/6
5,467,885 * 11/1995 Blinstrub ..... 220/6
5,515,987 * 5/1996 Jacques et al. ..... 220/6
5,725,119 * 3/1998 Bradford et al. ..... 220/6
5,938,059 * 8/1999 Luburic ..... 220/6

FOREIGN PATENT DOCUMENTS 401765 4/1996 (AT) .
4137095 5/1993 (DE) .
0786412 1/1997 (EP) .
9749613 12/1997 (WO) .

* cited by examiner

*Primary Examiner*—Joseph M. Moy
(74) *Attorney, Agent, or Firm*—Stevens, Davis, Miller & Mosher, L.L.P.

(57) ABSTRACT

A collapsible transport and storage container comprising a base member (2) and inwards foldable side walls (1) which are moveably attached to the base member (2) via hinges. The container is provided with upper hinge members (3') at the side walls (1) and lower hinge members (3") at the base member (2). The lower hinge members (3") are provided with assembly grooves (36). The assembly grooves (36) are applied in an angle (A) from the base surface of the base member (2). The side walls (1) are provided with one or more locking profiles (37) at their respective lower ends (1') which are intended to cooperate with the assembly grooves (36) during assembly and disassembly. The locking profiles (37) are provided with a locking edge (37') which runs against a wall member (33) during the main part of the folding and unfolding motion of the side wall (1). The invention also relates to a method to assemble such a container.

5 Claims, 4 Drawing Sheets

COLLAPSIBLE CONTAINER AND METHOD FOR THE ASSEMBLY OF SUCH A CONTAINER

The present invention relates to an improved hinge mechanism between the side walls and the base of a collapsible container and a method for the assembly of such a container.

Packages can be made of different materials such as wood, metal, plastics etc. One problem with most packages is that they will demand an equal amount of transport volume when returned to the source.

One alternative to return transport is the so-called one way package, which is disposed of when it has served its purpose.

Another way of solving the problem is to provide the package with a so-called nesting function. This means that empty packages is partly placed, one into the other, by providing them with sloping sides.

Yet another way to solve the problem is to make the sides of the containers removable or foldable. The most commonly known container with removable sides is the pallet and pallet-collar combination. One example of commonly used foldable package is the collapsible pallet container. The sides are here made foldable by attaching the side walls to the base part via hinges. One disadvantage with this type of package is that the mechanical stability is radically reduced when compared to solid, non-foldable containers. The main reason to this is that the corner sections of non-collapsible containers will absorb up to 80% of the load coming from above. It will be necessary to compensate for this by adding reinforcing profiles on the side walls since these load absorbing corners are parted on collapsible containers. This will, in addition to an increase in weight also lead to a package that is more difficult to clean due to all the pockets and recesses that are formed on the side walls. Furthermore, the hinges will also be exposed to a very high level of mechanical stress.

One problem with these containers is to achieve hinges that are easy to assemble and disassemble and which at the same time have a good load absorption capability since collapsible containers will be exposed to very high mechanical stress during its useful life. Since this type of container is assembled from a number of parts it is desirable to be able to replace damaged and worn parts that no longer meet the demands. These spare parts will then be manufactured at a different time than the parts they are to be assembled with. This means that the funcionality will not always be the desired one when parts are replaced, due to differences in manufacturing tolerances and thermal shrinkage.

It has through the present invention been possible to achieve a colapsible container where the above mentioned disadvantages and drawbacks has been avoided. The invention relates to a collapsible transport and storage container comprising a base member and inwards foldable side walls. The side walls are moveably attached to the base member via hinges. The container is manufactured through injection moulding of a thermoplastic material in one or more moulds. The moulds are provided with each one or more mould cavities in which the different parts are manufactured. The side walls are provided with upper hinge members at their respective lower ends, which upper hinge members are constituting an integrated part of the respective side wall. Said upper hinge members each includes a pivot shaft and a strut which pivot shaft extends mainly parallel to the profile which forms the lower end of the side wall. The strut extends mainly perpendicular downwards from said lower end as seen when the side wall is in erected position. Said pivot shafts are in one of their ends and in one piece, attached to each one outer end of a strut. The struts are attached to the lower end of the side wall via their respective other end. All pivot shafts are pointing in the same direction within one and the same side wall. The base member is provided with lower hinge members at its respective outer ends. The lower hinge members are constituting an integrated part of the base member, whereby said lower hinge members are constituted by wall members which are provided with holes. The wall members extends mainly perpendicular to the base surface of the base member and the extension of the pivot shaft. The holes, whose centre axis extends mainly parallel to the base surface of the base member and the outer end where the holes are located, are provided with a first hole wall and a second hole wall. The invention is characterised in that the lower hinge members are provided with assembly grooves in the form of recesses which are located in the wall members. The assembly groves extends mainly parallel to the extension of the pivot shaft. The assembly grooves are applied at an angle A from the base surface of the base member, as seen from an angle looking through the holes. The side walls are provided with one or more locking profiles at thier respective lower ends which are intended to cooperate with the assembly grooves during assembly and disassembly. The locking profiles are provided with a locking edge which runs against a wall member during the main part of the folding and unfolding motion of the side wall.

According to one embodiment of the invention the wall members of the base member are provided with support walls which extends mainly parallel to the extension of the pivot shaft.

The pivot shafts are preferably provided with a mainly circular cross-section which possibly is provided with recesses. This type of recesses are suitable since the pivot shafts often need to be of a heavier dimension that the rest of the container due to the mechanical stress they will be exposed to. Such a dimension would otherwise cause problems during cooling of the pivot shaft during manufacturing. The invention also relates to a procedure for the assembly of foldable side walls on a base part which side walls and base part together forms a collapsible container according to the invention. The invention is characterised in that the base part is provided with lower hinge members at its respective outer ends. The lower hinge members includes wall members which are provided with holes. The wall profiles extends mainly perpendicular to the base surface of the base member and perpendicular to the extension of an outer end placed closest to the wall member. The centre axis of the holes extends mainly parallel to the base surface of the base member and the outer end where the holes are applied. The lower hinge members are furthermore provided with assembly grooves in the form of recesses which are located in the wall members and/or possibly in connected support walls. The assembly grooves are applied at an angle from the base surface of the base member, as seen from an angle looking through the holes. The side walls are provided with upper hinge members at their respective lower edges. The upper hinge members each includes a pivot shaft and a strut which pivot shaft extends mainly parallel to the profile that forms the lower end of the side wall. Said strut extends mainly perpendicular downwards from said lower end as seen when the side wall is in erected position. All pivot shafts is pointing in the same direction within one and the same side wall. The side walls are furthermore provided with one or more locking profiles at their respective lower ends. The locking profiles are provided with a locking edge, whereby the side walls independantly is moved down towards the base member with the ends of the pivot shafts edge to edge with the vertical surfaces of the wall members. The side walls are introduced at an angle B between the base surface and the side wall so that the locking profiles falls into engagement with the assembly grooves. The side wall is then pushed in the direction of the pivot shafts so that the pivot shafts is brought into engagement with the holes. The locking profiles are hereby disengaged from the assembly grooves whereafter the side wall may be folded up and down and that the side wall is prevented from moving in a lenghtwise direction during most of the positions possible, preferably including the completelly erected and completelly down-folded positions, by the interacting contact between the locking edge of the locking profiles and the wall members and/or the edges of the possible connecting support walls. The angle A is preferably 0–90° while angle B, indepentant of angle A, is 0–90°, preferably 10–80°.

The invention is described further together with enclosed figures showing different embodiments of the invention wherein, FIG. 1*a* shows in perspective view and seen from the inside, parts of a base member 2 to a collapsible container according to the invention.

FIG. 1*b* shows in perspective view and seen from the inside, a part of a side wall 1 to a collapsible container according to the invention.

FIG. 2*a* shows in perspective view the base member 2 from FIG. 1*a,* as seen from the outside.

FIG. 2*b* shows in perspective view the side wall 1 from FIG. 1*b,* as seen from the outside.

Figure 5A:
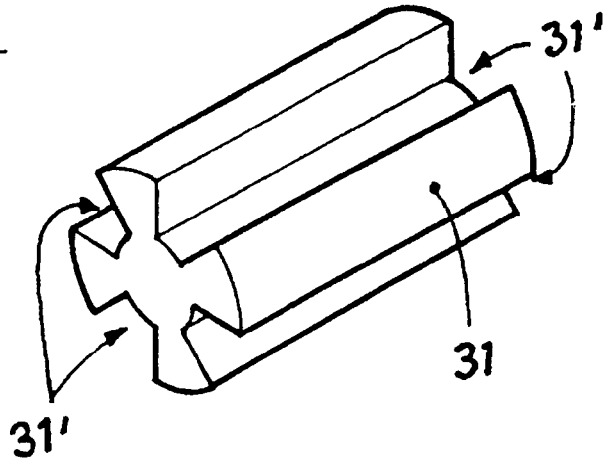
Figure 5B:
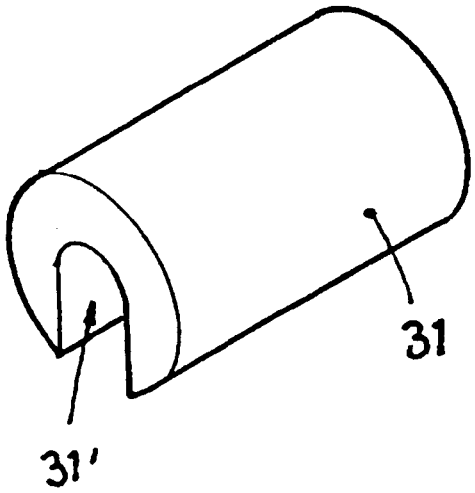
Figure 5C:
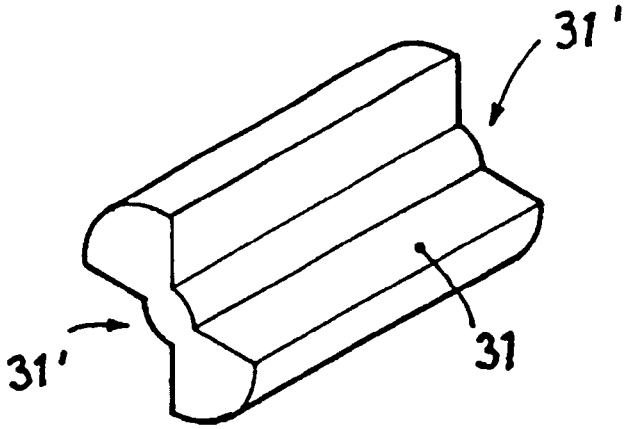

FIGS. 5*a*–5*c* shows in perspective view, different embodiments of pivot shafts 31.

Figure 1A:
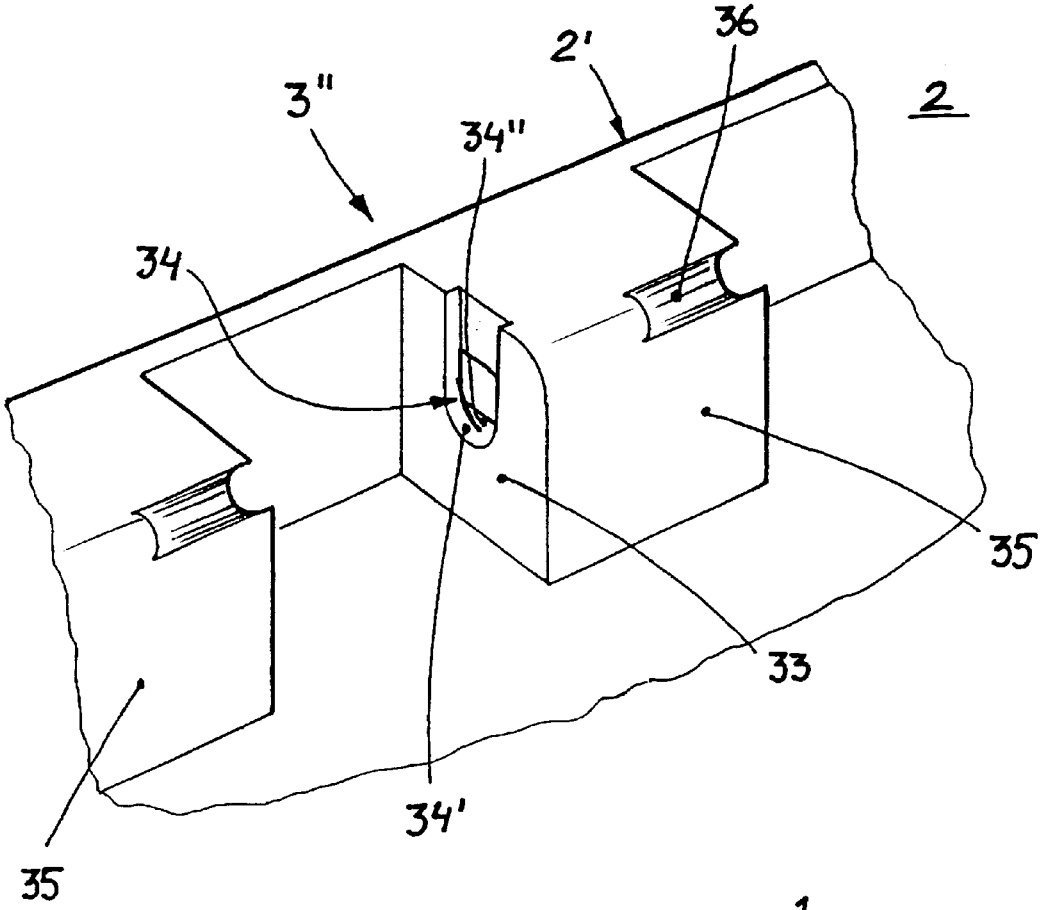
Figure 1B:
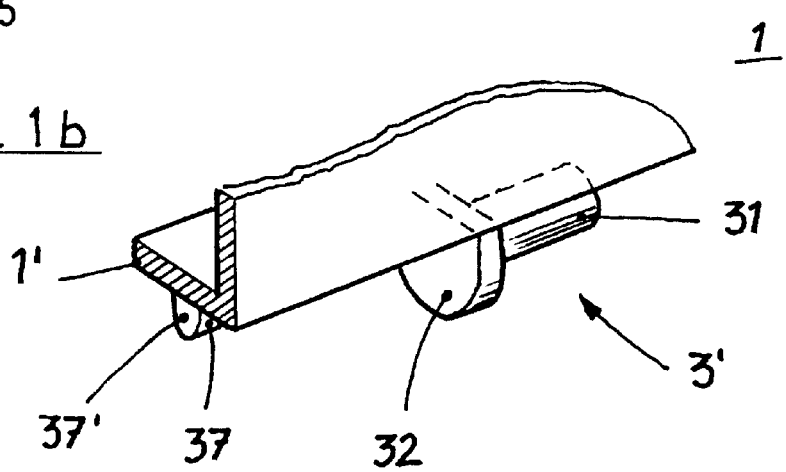
Figure 2A:
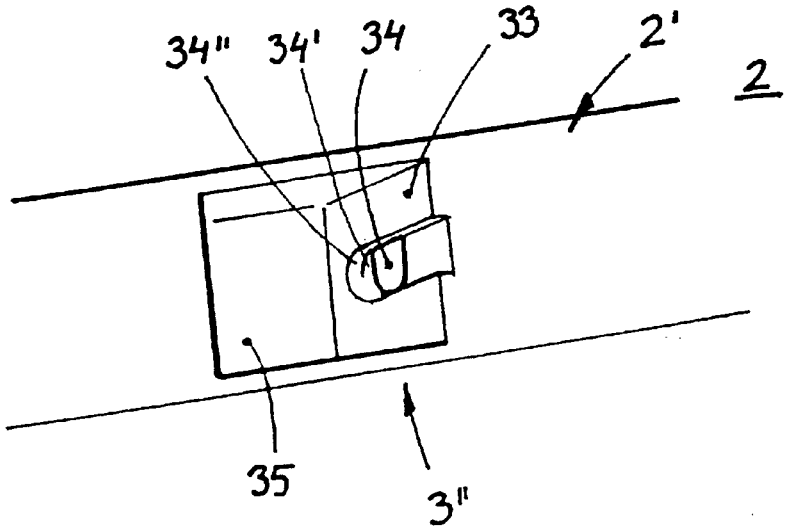
Figure 2B:
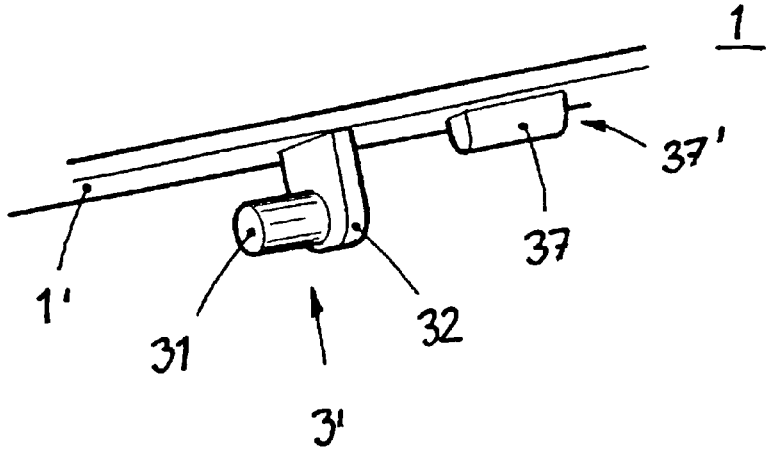

Accordingly, FIGS. 1*a,* 1*b,* 2*a* and 2*b* show in perspective view and seen from the inside (FIGS. 1*a* and 1*b*) and the outside (FIGS) 2*a* and 2*b*) respectivelly, parts of a base member 2 (FIGS. 1*a* and 2*a*)and side walls 1 (FIGS. 1*b* and 2*b*), respectivelly, to a collapsible container according to the invention. The base member 2 (FIGS. 1*a* and 2*a*) constitutes a part to a collapsible container for transport and storage and includes inwards foldable side walls 1 (FIGS. 1*b* and 2*b*) which are moveably attached to the base member 2 via hinges. The hinges are constituted by upper hinge members 3' (FIGS. 1*a* and 2*a*) and lower hinge members 3"(FIGS. 1*b* and 2*b*). The base member 2 is provided with lower hinge members 3" at its respective outer ends 2'. These lower hinge members 3" are manufactured in one piece with the base member 2. The lower hinge members 3" are constituted by wall members 33 which are provided with holes 34. The wall profiles 33 extends mainly perpendicular to the base surface of the base member 2 and to the extension of the pivot shaft 31. The holes 34, whose centre axis extends mainly parallel to the base surface of the base member 2 and parallel to the outer edge 2' where the holes 34 are located, are provided with a first hole wall 34' and a second hole wall 34". The side walls 1 (FIGS. 1*b* and 2*b*) are provided with upper hinge members 3' at their respective lower ends 1', which upper hinge members 3' are manufactured in one piece together with the respective side wall 1. These upper hinge members 3' includes each one pivot shaft 31 and one strut 32. The pivot shaft 31 extends mainly parallel to the profile which forms the lower end 1' of the side wall 1 while the strut 32 extends mainly perpendicular downwards from said lower end 1' as seen when the side wall is in an erected position. The pivot shafts 31 are in one of their ends connected to each one outer limitation of a strut 32. The struts 32 are in thier other ends in one piece connected to the side wall 1 at its lower end 1'. All pivot shafts 31 is, at one and the same side wall 1, directed in the same direction. The wall members 33 of the base member 2 are furthermore provided with support walls 35, which extends mainly parallel to the extension of the pivot shaft 31. The lower hinge members 3" are provided with assembly grooves 36 (FIGS. 1*a* and 3) in the form of recesses which are arranged in the wall members 33 and extends mainly parallel to the extension of the pivot shafts 31. The side walls 1 are, at their respective lower ends 1' provided with one or more locking profiles 37 (FIGS. 1*b* and 2*b*) which are intended to cooperate with the assembly grooves 36 during the assembly. The locking profiles 37 are provided with a locking edge 37" which runs against a wall member 33 during most of the folding and unfolding motion.

Figure 3:
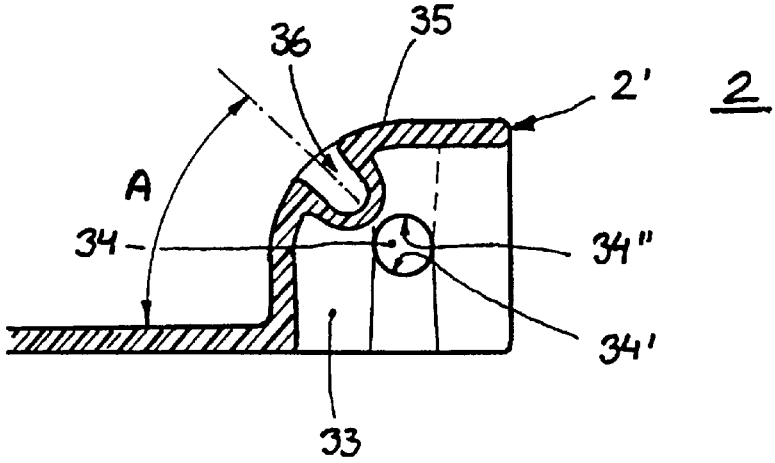
FIG. 3 shows in cross-section, parts of base member 2 according to the invention.
Figure 4:
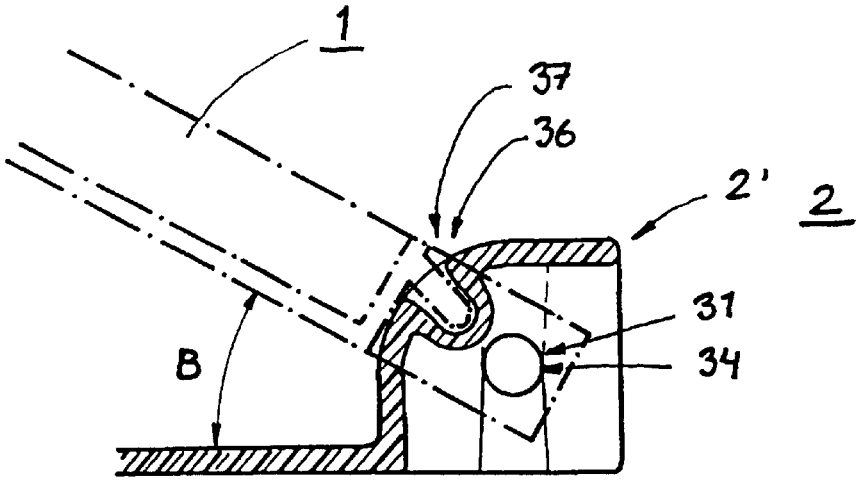
FIG. 4 shows in cross-section, parts of a base member 2 with a side wall 1 in assembly position.

FIGS. 3 and 4 show, in cross-section, parts of a base member 2 (FIG. 3) and parts of a base member 2 with a side wall 1 in assembly position (FIG. 4). The lower hinge members 3" are provided with assembly grooves 36 in the form of recesses which are arranged on the support walls 35. The assembly grooves 36 extends mainly parallel to the extension of the pivot shaft 31 (FIG. 1*b*). The assembly grooves 36 are arranged in an angle A from the base surface of the base member 2 as seen at an angle looking through the holes 34. The side walls 1 (FIG. 4) are at their respective lower ends 1' (FIG. 1*b*) provided with one or more locking profiles 37 which are intended to engage with the assembly grooves 36 during assembly and disassembly. The locking profiles 37 (FIG. 1*b*) are provided with a locking edge 37' which runs against a wall member 33 (FIG. 1*a*) or a support wall 35 (FIG. 1*a*) during most of the upfolding and down-folding motion. The side walls 1 are thereby assembled individually by being moved down towards the base member 2 with the ends 31' of the pivot shafts 31 edge to edge with the vertical surfaces of the wall members 33. The side walls 1 are introduced at an angle B between the base surface and the side wall 1 so that the locking profiles 37 falls into engagement with the assembly grooves 36. The side wall 1 is then pushed in the direction of the pivot shafts 31 so that the pivot shafts 31 is brought into engagement with the holes 34. The locking profiles 37 are hereby disengaged from the assembly grooves 36 whereafter the side wall 1 may be folded up and down and that the side wall 1 is prevented from moving in a lenghtwise direction during most of the positions possible, preferably including the completelly erected and completelly down-folded positions, by the interacting contact between the locking edge of the locking profiles and the wall members and/or the edges of the possible connecting support walls 35. The angel A and B may indepentantly be 0–90°. The angles are however selected so that completely up-folded and completely down-folded positions are avoided since the side wall 1 then might fall out of its engagement with the base member 2 in these most common positions.

FIGS. 5*a*–5*c* show in perspective view different embodiments of pivot shafts 31 with recesses 31'. The pivot shafts 31 have a mainly circular cross-section. The recesses 31' will make it possible to choose a heavier outer dimension on the pivot shafts 31 without causing any cooling related problems during manufacturing.

The invention is not limited to the embodiments shown since these can be varied in different ways within the scope of the invention.

What is claimed is:

1. A collapsible transport and storage container comprising a base member (2) and inwards foldable side walls (1) which are moveably attached to the base member (2) via hinges, which container is manufactured through injection moulding of a thermoplastic material in one or more moulds provided with each one or more mould cavities in which the different parts are manufactured, that the side walls (1) are provided with upper hinge members (3') at thier respective lower ends (1'), which upper hinge members (3') are constituting an integrated part of the respective side wall (1), whereby said upper hinge members (3') each includes a pivot shaft (31) and a strut (32) which pivot shaft (32) extends mainly parallel to the profile which forms the lower end (1') of the side wall (1) and which strut (32) extends mainly perpendicular downwards from said lower end (1') as seen when the side wall is in erected position, that said pivot shafts (31) in one of their ends is, in one piece, attached to each one outer end of a strut (32), which struts (32) are attached to the lower end (1') of the side wall (1) via their respective other end, that all pivot shafts (31) are pointing in the same direction within one and the same side wall (1), that the base member (2) is provided with lower hinge members (3") at its respective outer ends (2'), which lower hinge members (3") are constituting an integrated part of the base member (2), whereby said lower hinge members (3") are constituted by wall members (33) which are provided with holes (34), which wall members (33) extends mainly perpendicular to the base surface of the base member (2) and the extension of the pivot shaft (31), that the holes (34), whose centre axis extends mainly parallel to the base surface of the base member (2) and that the outer end (2') where the holes (34) are located are provided with a first hole wall (34') and a second hole wall (34"), characterised in that the lower hinge members (3") are provided with assembly grooves (36) in the form of recesses which are located in the wall members (33) and which extends mainly parallel to the extension of the pivot shaft (31) and which assembly grooves (36) are plied in an angle (A) from the base surface of the base member (2) as seen from an angle looking through the holes (34) and that the side walls (1) are provided with one or more locking profiles (37) at thier respective lower ends (1') which are intended to cooperate with the assembly grooves (36) during assembly and disassembly, which locking profiles (37) are provided with a locking edge (37') which runs against a wall member (33) during the main part of the folding and unfolding motion of the side wall (1).

2. The collapsible container according to claim 1 characterised in that the wall members (33) of the base member (2) are provided with support walls (35) which extends mainly parallel to the extension of the pivot shaft (31).

3. Collapsible container according to claim 2 characterised in that the pivot shafts (31) are provided with a mainly circular cross-section which possibly is provided with recesses (31').

4. A method for the assembly of foldable side walls (1) on a base part (2) which side walls (1) and base part (2) together forms a collapsible container, characterised in that the base part (2) is provided with lower hinge members (3") at its respective outer ends (2'), which lower hinge members (3") includes wall members (33) which are provided with holes (34), which wall profiles (33) extends mainly perpendicular to the base surface of the base member (2) and perpendicular to the extension of an outer end (2) placed closest to the wall member (33), that the centre axis of the holes (34) extends mainly parallel to the base surface of the base member (2) and the outer end (2') where the holes (34) are applied, and furthermore that the lower hinge members (3") are provided with assembly grooves (36) in the form of recesses which are located in the wall members (33) and/or possibly connected support walls (35), which assembly grooves (36) are applied at an angle (A) from the base surface of the base member (2) as seen from an angle looking through the holes (34), that the side walls (1) are provided with upper hinge members (3') at their respective lower edges (1'), which upper hinge members (3') each includes a pivot shaft (31) and a strut (32) which pivot shaft (31) extends mainly parallel to the profile that forms the lower end (1') of the side wall (1) and which strut (32) extends mainly perpendicular downwards from said lower end (1') as seen when the side wall (1) is in erected position, that all pivot shafts (31) are pointing in the same direction within one and the same side wall (1), that the side walls (1) furthermore are provided with one or more locking profiles (37) at their respective lower ends (1'), which locking profiles (37) are provided with a locking edge (37'), whereby the side walls (1) independantly are moved down towards the base member (2) with the ends (31') of the pivot shafts (31) edge to edge with the vertical surfaces of the wall members (33), that the side walls (1) are introduced at an angle (B) between the base surface and the side wall (1) so that the locking profiles (37) falls into engagement with the assembly grooves (36) whereby each side wall (1) is pushed in the direction of the pivot shafts (31) so that the pivot shafts (31) are brought into engagement with the holes (34) whereby the locking profiles (37) are disengaged from the assembly grooves (36) whereafter the side wall (1) may be folded up and down and that each side wall (1) is prevented from moving in a lenghtwise direction during most of the positions possible, preferably including the completelly erected and completelly downfolded positions, by the interacting contact between the locking edge (37') of the locking profiles (37) and the wall members (33) and/or the edges of the possible connecting support walls (35).

5. The method according to claim 4 characterised in the angle (A) is 0–90° while angle (B), indepentant of angle (A), is 0–90°, preferably 10–80°.

* * * * *